US007851116B2

(12) United States Patent
Veregin et al.

(10) Patent No.: US 7,851,116 B2
(45) Date of Patent: Dec. 14, 2010

(54) EMULSION AGGREGATION HIGH-GLOSS TONER WITH CALCIUM ADDITION

(75) Inventors: Richard P. N. Veregin, Mississauga (CA); Allan K. Chen, Oakville (CA); Cuong Vong, Hamilton (CA); Vladislav Skorokhod, Mississauga (CA); Eric M. Strohm, Burlington (CA); Michael S. Hawkins, Cambridge (CA); Christine D. Anderson, Hamilton (CA); Richard Fong, Webster, NY (US); Nancy S. Hunt, Ontario, NY (US); Vincenzo G. Marcello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 846 days.

(21) Appl. No.: 11/554,322

(22) Filed: Oct. 30, 2006

(65) Prior Publication Data

US 2008/0166648 A1 Jul. 10, 2008

(51) Int. Cl.
*G03G 9/08* (2006.01)

(52) U.S. Cl. ..... 430/108.6; 430/108.1; 430/108.3; 430/109.3; 430/111.4; 430/111.14; 430/137.14

(58) Field of Classification Search ..... 430/108.1, 430/109.3, 111.4, 111.41, 137.14, 108.6, 430/108.7, 108.3
See application file for complete search history.

(56) References Cited

U.S. PATENT DOCUMENTS 5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,559,541 A * 9/1996 Asanae et al. ..... 347/55
5,585,215 A 12/1996 Ong et al.
5,593,807 A 1/1997 Sacripante et al.
5,650,255 A 7/1997 Ng et al.
5,650,256 A 7/1997 Veregin et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,827,633 A 10/1998 Ong et al.
5,840,462 A 11/1998 Foucher et al.
5,853,944 A 12/1998 Foucher et al.
5,869,215 A 2/1999 Ong et al.
6,140,003 A 10/2000 Sacripante et al.
6,177,221 B1 * 1/2001 Maniar et al. ..... 430/111.3
6,338,929 B1 * 1/2002 Hagi et al. ..... 430/108.4
6,569,589 B2 * 5/2003 Inaba et al. ..... 430/108.22
2003/0215730 A1 * 11/2003 Srinivasan et al. ..... 430/108.3
2005/0136351 A1 * 6/2005 Vandewinckel et al. .. 430/107.1
2005/0136352 A1 * 6/2005 Vandewinckel et al. .. 430/107.1
2005/0176853 A1 * 8/2005 Hopper et al. ..... 523/333
2006/0121382 A1 * 6/2006 Choi et al. ..... 430/108.21
2006/0269859 A1 * 11/2006 Skorokhod et al. ..... 430/108.3
2007/0020554 A1 * 1/2007 Chen et al. ..... 430/137.14
2007/0077510 A1 * 4/2007 Nosella et al. ..... 430/109.4
2007/0111129 A1 * 5/2007 Patel et al. ..... 430/108.8
2008/0107988 A1 * 5/2008 Vandewinckel et al. .. 430/109.3

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*
Diamond, Arthur S & David Weiss (eds.) Handbook of Imaging Materials, 2nd ed.. New York: Marcel-Dekker, Inc. (Nov. 2001) pp. 178-182.*
U.S. Appl. No. 11/274,459.
U.S. Appl. No. 11/278,762.

* cited by examiner

*Primary Examiner*—Christopher RoDee
(74) *Attorney, Agent, or Firm*—Oliff & Berridge, PLC

(57) ABSTRACT

Toner including toner particles having a calcium-containing material at least in a surface portion of the toner particle, wherein the toner particles contain calcium in an amount of from 20 ppm to about 300 ppm of calcium by dry weight of the toner. Developer including a carrier and a toner, wherein the toner includes toner particles having a calcium-containing material at least in a surface portion of the toner particles. In an emulsion aggregation process for making toner particles, the toner particles are treated with calcium. The addition of calcium to the toner particles improves toner performance by lowering cohesion and charging, thereby generating an image of high gloss.

18 Claims, No Drawings

EMULSION AGGREGATION HIGH-GLOSS TONER WITH CALCIUM ADDITION

BACKGROUND

The present disclosure generally relates to toners and developers containing toners, and their use in methods for forming and developing images of good quality and gloss, and in particular to emulsion aggregate toners.

The toners herein are advantageous in desired print quality and high gloss, and improved cohesion and charging in all ambient environments.

REFERENCES

Toners and developers containing toners are essential components of any electrophotographic image forming system. In conventional electrophotographic image forming systems, an image is first projected onto a photoreceptor by performing a charging process and an exposure process. An electrostatic latent image is formed on the photoreceptor by first charging developers and then shifting the charged toner particles of the developers to the photoreceptor to develop the electrostatic latent image. Next, the developed electrostatic latent image is transferred onto a recording medium, for example paper. Finally, a fixed electrostatic image is obtained by fusing the toners to the recording medium using heat, pressure and/or light.

One way for developing an electrostatic latent image is a one-component developing process using only a toner. Another way is known as a two-component developing process using a toner and a carrier. In the two-component developing process, the toner and the carrier are mixed to become electrically charged with opposite polarities through triboelectrification.

Emulsion aggregation toners are excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,744,520, 5,763,133, 5,766,818, 5,747,215, 5,827,633, 5,853,944, 5,840,462, and 5,869,215.

In conventional developers that contain emulsion aggregation toners, the developers can form clumps and build up on the auger inside the developer housing. During high volume print runs, heat generated by the system may cause the developer housing sump to overheat. Upon exposure to heating, the developers within the developer housing agglomerate and form clumps. These developer clumps can stick to the auger instead of being freely transported in the developer housing for proper image development. As a result, the clumps of developer may cause streaks in the toner image on a recording medium such as paper, resulting in image quality degradation. Such developer clumps can also collect in the area of the toner concentration (TC) sensor, resulting in an incorrect reading of the toner concentration, so that the toner concentration becomes uncontrolled. This can result in toner undesirably printing in the background of the recording medium.

U.S. patent application Ser. No. 11/278,762, the disclosure of which is incorporated herein by reference in its entirety, describes a developer containing a carrier and a toner, wherein the toner contains toner particles of at least one binder, at least one colorant, and external additives, wherein the developer has a trimmer clogging value in relation to toner triboelectric charge and toner cohesion expressed according to the equation (−0.80+0.039×(% toner cohesion)+0.026×(toner triboelectric charge) (μC/g)) of less than or equal to about 3.2. The developer has improved image gloss, reduced trimmer clogging and improved blocking performance by modifying blending conditions.

While known compositions and processes are suitable for their intended purposes, and in fact materials of such known compositions can be used herein as appropriate, a need remains for improved emulsion aggregation (or EA) toners and developers containing EA toners, for example EA high-gloss toners, that exhibit improved cohesion and charging, and thus improve trimmer clogging performance, and processes thereof that provide an effective alternative to current toners.

SUMMARY

These and other improvements are accomplished by the toners and developers described herein.

In embodiments, described is a toner comprising toner particles having a calcium-containing material at least in a surface portion of the toner particles, wherein the toner particles contain calcium in an amount of from about 20 ppm to about 300 ppm of calcium by dry weight of the toner.

In embodiments, described is a process for making toner particles comprising treating the toner particles with a calcium-containing material.

In embodiments, an electrophotographic image forming apparatus is described that includes a photoreceptor, a development system, and a housing in association with the development system and containing a developer comprising a carrier and a toner, wherein the toner comprises toner particles having a calcium-containing material at least in a surface portion of the toner particles.

Embodiments

It is desirable to have a toner including toner particles with calcium in at least the surface of the toner particles. "Surface" as described herein includes, for example, the exterior or outside layer of the toner particles. It is desired that the calcium be located on the surface, on top of the resin and not buried beneath the resin of the toner. The calcium is desirably added to at least the surface of the toner prior to addition of external surface additives, although it may also be added at the same time as or after addition of any external surface additives.

"Calcium-containing material" herein refers to, for example, material containing calcium and including, for example, calcium-containing salts such as calcium chloride and the like.

Toners and developers containing toners desirably possess certain properties related to cohesion and charge level. That is, it is desired to have toners and developers with improved toner performance, such as toners having lower cohesion and lower charge level.

Another desirable property of a toner is low trimmer clogging. Both cohesion and charge level may be associated with trimmer clogging, which is a property associated with high-gloss developers.

Disclosed herein are emulsion aggregation toners, developers containing the toners, and processes for making emulsion aggregation toners, that exhibit one or more of the above desirable properties.

During the process of making an EA toner, aggregation may be assisted by utilizing a coagulant. However, coagulants, such as metal ion coagulants, for example aluminum coagulant, such as poly-aluminum chloride (PAC) and poly-aluminum sulfosilicate (PASS), can introduce metal ions to the toner that cause a decrease in toner performance. The metal ions present in the toner can create ionic crosslinking in the end toner, which may reduce gloss. Thus, the process of making an EA toner using coagulants also generally involves use of a metal sequestering agent following aggregation to sequester or extract a metal complexing ion such as aluminum from the toner to avoid such known problems.

However, the use of metal sequestering agents may also result in the removal of calcium from the toner. Herein, it was found that this loss of calcium may result in increased cohesion and increased charge level of the toner.

It is thus desirable to return calcium to the surface of toner subjected to sequestering agent treatment to improve toner performance. That is, adding calcium to the surface of the toner improves toner performance by lowering cohesion and charge level, and thus provides low trimmer clogging performance of the toner. It has also been found desirable to treat toner particles not otherwise subjected to sequestering agent treatment so as to introduce a calcium-containing material onto the surfaces of the toner particles to ensure suitable cohesion and charge level properties in such toners.

In embodiments, a calcium-containing material is introduced and/or reintroduced to the toner via a washing procedure wherein toner particles are washed with a calcium-containing material, such as calcium salts like calcium chloride. Toners wherein calcium is removed by a sequestering agent during the EA process thus have calcium reintroduced to at least the surface of the toner.

In embodiments, after removing a coagulant ion such as aluminum with the sequestering agent, and after washing the toner particles with deionized water, a final wash with a calcium-containing material returns calcium to the surface of the toner. Thus, the toner particles are treated with the calcium-containing material.

In forming particles via an EA process, any suitable EA process may be used. For example, a typical process may include generating an emulsion of resin by dispersing the resin in an aqueous medium. As one example, the emulsion may be formed by dissolving the resin in an organic solvent, dispersing with a mixer in water followed by heating to remove the organic solvent, thereby resulting in a latex emulsion. Desirably, the emulsion includes seed particulates of the resin having an average size of, for example, from about 10 to about 500 nm, such as from about 10 nm to about 400 nm or from about 25 nm to about 250 nm.

Once the emulsion is generated, an optional wax, or colorant and/or surfactant may be added to the emulsion. The emulsion is then subjected to aggregation. During aggregation, the emulsion is subjected to conditions including, for example, elevated temperatures in the presence of an optional coagulant and/or surfactant wherein the aggregate grows. The emulsion is aggregated until the desired particle size is obtained. If desired, during aggregation an additional amount of binder, optionally with wax, may be added so as to form a shell on the aggregated core particles. Aggregation may be stopped when the desired particle size is achieved, for example by adjusting the pH, lowering temperature and/or adding an optional sequestering agent. In embodiments, a sequestering agent may optionally be introduced to sequester or extract a metal complexing ion such as aluminum from the coagulant during the EA process. Toner particles may be optionally coalesced to form more spherical and smoother particles.

In embodiments, the process may include generating an emulsion of resin in water, adding thereto optional components such as a colorant and/or wax dispersion, and optional surfactants, heating to a temperature of from about 30° C. to about 90° C. in the presence of at least one coagulant, wherein particle aggregates grow, optionally adjusting the pH, for example via addition of a base such as NaOH, and heating to a temperature of from about 80° C. to 100° C. to coalesce the particles, and cooling, wherein the toner particles are washed with deionized water and then washed with a calcium-containing material, such as calcium chloride. At any part following aggregation, a sequestering agent may be added to substantially remove coagulant ions from the particles.

The calcium may be any suitable calcium-containing material including, for example, calcium suitable for depositing or transferring calcium to the surface of the toner, such as calcium chloride, calcium acetate, calcium bromide, calcium citrate, calcium hydroxide, calcium nitrate, calcium sulphate and hydrates thereof, or any water soluble calcium. In embodiments, a one percent calcium chloride dihydrate solution may be used to treat the toner particles with calcium. Toner particles may be treated with the calcium-containing material during a washing of the toner particles. In embodiments, the toner particles are treated with calcium-containing material after the toner particles are formed and washed.

In embodiments, the calcium is added into at least the surface of the toner in an amount of from about 20 ppm to about 300 ppm of calcium to the dry weight of the toner, for example from about 100 ppm to about 300 ppm of calcium to the dry weight of the toner, and such as from about 20 ppm to about 100 ppm of calcium to the dry weight of the toner. Because it is difficult to ascertain the exact amount of calcium on the surface of the toner particles alone, the amount of total calcium by weight of dry toner is measured.

Also, the aluminum content of the toner, for example as a result of the use of an aluminum containing coagulant, is in an amount of from about 100 ppm to about 500 ppm of aluminum to the dry weight of the toner, for example from about 300 ppm to about 500 ppm of aluminum to the dry weight of the toner, and such as from about 150 ppm to about 400 ppm of aluminum to the dry weight of the toner.

In embodiments, the toner comprises toner particles of at least one resin. Any suitable resin for use in toner may be employed. Toners prepared by chemical methods such as emulsion aggregation may particularly be used, although toners prepared by physical methods such as grinding may also be employed.

The resin may be a polyester resin, for example made by an EA process. Polyester resins are illustrated in a number of patents, such as U.S. Pat. Nos. 5,593,807, 5,290,654, 5,308,734 and 5,370,963, each of which are incorporated herein by reference in their entirety. The polyester may comprise any of the polyester materials described in the aforementioned references.

In embodiments, the polyester may be a sulfonated polyester, specific examples of which include those as illustrated in U.S. Pat. No. 6,140,003, the disclosure of which is totally incorporated herein by reference, such as a sodio sulfonated polyesters, and more specifically, a polyester, such as poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene-sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), copoly(propoxylated bisphenol A)-co-poly-(propoxylated bisphenol A-sodio 5-sulfoisophthalate) bisphenylene, bis(alkyloxy) bisphenolene, and the like. The polyester may also be an alkali sulfonated polyester resins, such as the metal or alkali salts of copoly(ethylene-terephthalate)-copoly(ethylene-5-sulfo-isophthalate), copoly(propylene-terephthalate)-copoly(propylene-5-sulfoisophthalate), copoly(diethylene-terephthalate)-copoly(diethylene-5-sulfoisophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfoisophthalate), copoly(ethoxylated bisphenol-A-fumarate)-copoly(ethoxylated bisphenol-A-5-sulfoisophthalate), and copoly(ethoxylated bisphenol-A-maleate)-copoly (ethoxylated bisphenol-A-5-sulfo-isophthalate), and wherein the alkali metal is, for example, a sodium, lithium or potassium ion.

In embodiments, the resin may be a styrene/acrylate resin, for example made by an EA process. Such are illustrated in a number of patents, for example U.S. Pat. Nos. 5,278,020, 5,290,654, 5,308,734, 5,344,738, 5,346,797, 5,364,729, 5,370,963, 5,403,693, 5,418,108, and 5,763,133, the disclosures of each of which are incorporated herein by reference in their entirety. The styrene/acrylate resin may comprise any of the materials described in the aforementioned references.

The resin may be derived from monomers or oligomers, and the monomers or oligomers utilized may include any one or more of, for example, butadienes, isoprene, acrylonitrile, acrylic acid, methacrylic acid, beta-carboxy ethyl acrylate, and the like. In addition, the resin may be derived from polymers or copolymers. Illustrative examples of styrene/acrylates include known polymers selected from the group consisting of styrene acrylates, styrene methacrylates, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and styrene/butyl acrylate/carboxylic acid terpolymers, styrene/butyl acrylate/beta-carboxy ethyl acrylate terpolymers, PLIOTONE™ available from Goodyear, mixtures thereof, and the like.

The resin selected, such as styrene acrylates, styrene butadienes, styrene methacrylates, and the like, may be present in various effective amounts, such as from about 50 weight percent to about 98 weight percent, and more specifically, about 70 weight percent to about 95 weight percent, based upon the total weight percent of the particles. Prior to aggregation in EA processes, the resin may be of small average particle size, such as from about 0.01 micron to about 1 micron in average volume diameter as measured by the Brookhaven nanosize particle analyzer. Other effective amounts of resin may be selected.

In addition, the resin may be derived from more than one type of polymer. For example, two polymer resins may be present in the toner particles, such as a first polymer of styrene methacrylate that may be present in an amount of from about 15 percent to about 30 percent by weight of the toner particles, more specifically from about 20 percent to about 25 percent by weight of the toner particles or from about 25 percent to about 30 percent by weight of the toner particles, with a second polymer of styrene butadiene in an amount of from about 85 percent to about 70 percent by weight of the toner particles, more specifically from about 80 percent to about 75 percent by weight of the toner particles or from about 75 percent to about 70 percent by weight of the toner particles.

The styrene/acrylate resin may comprise, for example, a styrene:butyl acrylate:beta-carboxy ethyl acrylate, wherein, for example, the monomers are present in an amount of about 40% to about 95% styrene, about 5% to about 60% butyl acrylate, and about 0.05 parts per hundred to about 10 parts per hundred beta-carboxy ethyl acrylate; or about 60% to about 85% styrene, about 15% to about 40% butyl acrylate, and about 1 part per hundred to about 5 parts per hundred beta-carboxy ethyl acrylate, by weight based upon the total weight of the monomers or oligomers.

In embodiments, the toner particles may contain a polymer core and a polymer shell that encapsulates the polymer core. The polymer core and the polymer shell may each comprise, for example, a styrene:butyl acrylate:beta-carboxy ethyl acrylate, wherein, for example, the monomers are present in an amount of about 40% to about 90% styrene, about 5% to about 60% butyl acrylate, and about 1% to about 10% beta-carboxy ethyl acrylate; such as about 80% to about 90% styrene, about 10% to about 30% butyl acrylate, and about 2% to about 8% beta-carboxy ethyl acrylate or about 70% to about 85% styrene, about 15% to about 25% butyl acrylate, and about 1% to about 5% beta-carboxy ethyl acrylate, by weight based upon the total weight of the monomers or oligomers.

In embodiments, a polymer shell that encapsulates the polymer core may be free of colorant and/or wax, as desired.

Additionally, in preparing the toner by the emulsion aggregation procedure, one or more surfactants may be used in the process. Suitable surfactants may include anionic, cationic and nonionic surfactants.

Anionic surfactants include, for example, sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN RK™, NEOGEN SC™ from Kao, mixtures thereof and the like.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, mixtures thereof and the like. An example of a desirable cationic surfactant is SANISOL B-50 available from Kao Corp., which comprises primarily benzyl dimethyl alkonium chloride.

Examples of nonionic surfactants may include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™ and mixtures thereof.

Examples of additional surfactants, which may be added optionally to the aggregate suspension prior to or during the coalescence to, for example, prevent the aggregates from growing in size, or for stabilizing the aggregate size, with increasing temperature, include anionic surfactants such as sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™ available from Daiichi Kogyo Seiyaku, and the like, among others.

Furthermore, the toner compositions may also include suitable waxes, for example as a release agent. In embodiments, a suitable wax may be polyethylene, polypropylene, paraffin, Fischer-Tropsch, microcrystalline wax, carnauba wax, jojoba wax, rice wax, beeswax, montanic acid ester wax, castor wax, and mixtures thereof. In embodiments, the wax is a polyethylene wax or a Fischer Tropsch wax, and in specific embodiments, fractionated, crystalline, and/or distilled polyethylene wax. The polyethylene wax, in embodiments, is derived from ethylene polymerization. A toner composition having a crystalline or distilled polyethylene wax is illustrated in, for example, U.S. patent application Ser. No. 11/274,459, filed Nov. 14, 2005, entitled, "Toner Having Crystalline Wax," the disclosure of which is incorporated herein by reference in its entirety.

In embodiments, the wax is added to the starting emulsion in the form of a dispersion comprising, for example, a wax having a particle diameter of about 100 nanometers to about 500 nanometers, or about 100 nanometers to about 300 nanometers, water, and an anionic surfactant or a polymeric stabilize, and optionally a nonionic surfactant. The surfactant used to disperse the wax may be an anionic surfactant, although not limited thereto, such as, for example, NEOGEN RK® commercially available from Daiichi Kogyo Seiyaku or TAYCAPOWER® BN2060 commercially available from Tayca Corporation or DOWFAX available from DuPont.

The wax may be present in the toner composition in various amounts. However, generally the wax may be present in the toner composition in an amount of from about 5 percent by weight to about 25 percent by weight, for example in an amount of from about 5 percent by weight to about 15 percent by weight or from about 8 percent by weight to about 10 percent by weight, based on the weight of the toner composition.

In embodiments, colorants may be included in the particles, for example where it is desired to use the particles as toner particles. The colorant may be pigments, dyes, mixtures of pigment and dyes, mixtures of pigments, mixtures of dyes, and the like. A dye is a substance that is used to color material. The term "color" may encompass a number of aspects such as hue, lightness and saturation, where one color may be different from another color if the two colors differ in at least one of these aspects. For example, two colors having the same hue and saturation but different in lightness would be consider different colors. Any suitable colors such as, for example, red, white, black, gray, yellow, cyan, magenta, blue and purple, can be used to produce a color. Various known colorants, such as pigments, may be present in the toner in an amount of, for example, from about 1 to about 25 percent by weight of toner, such as in an amount of from about 3 to about 10 percent by weight or from about 5 to about 20 percent by weight.

Examples of suitable colorants for making toners include carbon black such as REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected, for example, various known cyan, magenta, yellow, red, green, brown, blue colorants or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan, magenta, yellow components may also be selected as pigments. The colorants, such as pigments, selected can be flushed pigments as indicated herein. Colorant examples further include Pigment Blue 15:3 having a Color Index Constitution Number of 74160, Magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions commercially available from Clariant include HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02, which can be dispersed in water and/or surfactant prior to use.

In embodiments, the colorant, for example carbon black, cyan, magenta and/or yellow colorant, may be incorporated in an amount sufficient to impart the desired color to the toner. In general, pigment or dye, may be employed in an amount ranging from about 2% to about 35% by weight of the toner particles on a solids basis, more specifically, from about 5% to about 25% by weight or from about 5% to about 15% by weight. In embodiments, more than one colorant may be present in the toner particles.

In embodiments, the coagulant used in forming particle aggregates may be an inorganic coagulant. Inorganic cationic coagulants include, for example, poly-aluminum chloride (PAC), poly-aluminum sulfosilicate (PASS), aluminum sulfate, zinc sulfate, magnesium sulfate, chlorides of magnesium, calcium, zinc, beryllium, aluminum, sodium, other metal halides including monovalant and divalent halides, and the like. The coagulant can be present in an aqueous medium in an amount of from, for example, from about 0.05 to about 10 percent by weight, or from about 0.075 to about 5.0 percent by weight of total solids in the toner. The coagulant may also contain minor amounts of other components, for example nitric acid.

In embodiments, polyaluminum chloride (PAC) is used as a coagulant. This coagulant causes crosslinking and hence reduces the gloss of the toner if not removed. An optional sequestering agent may be introduced following completion of particle aggregation to sequester or extract the metal complexing ion such as aluminum of the coagulant.

In embodiments, the optional sequestering or complexing component may comprise an organic complexing component selected from the group consisting of ethylenediaminetetraacetic acid (EDTA), gluconal, sodium gluconate, potassium citrate, sodium citrate, nitrotriacetate salt, humic acid, and fulvic acid; salts of ethylenediaminetetraacetic acid, gluconal, sodium gluconate, potassium citrate, sodium citrate, nitrotriacetate salt, humic acid, and fulvic acid, alkali metal salts of ethylenediaminetetraacetic acid, gluconal, sodium gluconate, potassium citrate, sodium citrate, nitrotriacetate salt, humic acid, and fulvic acid; sodium salts of ethylenediaminetetraacetic acid, gluconal, sodium gluconate, tartaric acid, gluconic acid, oxalic acid, polyacrylates, sugar acrylates, citric acid, potassium citrate, sodium citrate, nitrotriacetate salt, humic acid, and fulvic acid; potassium salts of ethylenediaminetetraacetic acid, gluconal, sodium gluconate, potassium citrate, sodium citrate, nitrotriacetate salt, humic acid, and fulvic acid; and calcium salts of ethylenediaminetetraacetic acid, gluconal, sodium gluconate, potassium citrate, sodium citrate, nitrotriacetate salt, humic acid, fulvic acid, calcium disodium ethylenediaminetetraacetate dehydrate, diammoniumethylenediaminetetraacetic acid, pentasodium diethylenetriaminepentaacetic acid sodium salt, trisodium N-(hydroxyethyl)-ethylenediaminetriacetate, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, nitrilo triacetic acid sodium salt, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, and mixtures thereof.

In embodiments, the optional sequestering or complexing component may comprise an inorganic complexing component selected from the group consisting of sodium silicate, potassium silicate, magnesium sulfate silicate, sodium hexameta phosphate, sodium polyphosphate, sodium tripolyphosphate, sodium trimeta phosphate, sodium pyrophosphate, bentonite, and talc, and the like. Organic and inorganic complexing components can be used in an amount of about 0.01 weight percent to about 10 weight percent, such as from about 0.4 weight percent to about 8 weight percent or from about 5 weight percent to about 10 weight percent based upon the total weight of the toner.

In embodiments, external additives may be added to the particles before, during or after the core toner particles have been treated with calcium. It is desirable to have external additives added after the particles have been treated with calcium. The particles may be blended, after drying, with an external additive package using a blender such as a Henschel blender. It is also possible to add an external additive package to the particles before, during or after the particles are treated with calcium. External additives are additives that associate with the surface of the toner particles. In embodiments, the external additive package may include one or more of silicon dioxide or silica ($SiO_2$), titania or titanium dioxide ($TiO_2$), and cerium oxide. Silica may be a first silica and a second silica. The first silica may have an average primary particle size, measured in diameter, in the range of, for example, from about 5 nm to about 50 nm, such as from about 5 nm to about 25 nm or from about 20 nm to about 40 nm. The second silica may have an average primary particle size, measured in diameter, in the range of, for example, from about 100 nm to about 200 nm, such as from about 100 nm to about 150 nm or from about 125 nm to about 145 nm. The second silica external additive particles have a larger average size (diameter) than the first silica. The titania may have an average primary particle size in the range of, for example, about 5 nm to about 50 nm, such as from about 5 nm to about 20 nm or from about 10 nm to about 50 nm. The cerium oxide may have an average primary particle size in the range of, for example, about 5 nm to about 50 nm, such as from about 5 nm to about 20 nm or from about 10 nm to about 50 nm.

Zinc stearate may also be used as an external additive. Calcium stearate and magnesium stearate may provide similar functions. Zinc stearate may have an average primary particle size in the range of, for example, about 500 nm to about 700 nm, such as from about 500 nm to about 600 nm or from about 550 nm to about 650 nm.

In embodiments, the external additive package may comprise a first silica, a second silica, titania, an optional cerium oxide and an optional zinc stearate.

The first silica may be present in the toner particles in amounts of, for example, from about 0.5% to about 2.5% by weight of the toner particles, such as from about 1.5% to about 1.8% or from about 1.6% to about 1.9% by weight of the toner particles. The second silica may be present in the toner particles in amounts of, for example, from about 0.5% to about 2% by weight of the toner particles, such as from about 1.5% to about 1.8% or from about 1.6% to about 1.9% by weight of the toner particles. Titania may be present in the toner particles in amounts of, for example, from about 0.5% to about 2% by weight of the toner particles, such as from about 0.5% to about 1.5% or from about 0.6% to about 0.9% by weight of the toner particles. Cerium oxide may be present in the toner particles in amounts of, for example, from about 0.2% to about 1% by weight of the toner particles, such as from about 0.3% to about 0.7% or from about 0.5% to about 1% by weight of the toner particles. The zinc stearate may be present in the toner particles in amounts of, for example, from about 0.1% to about 1% by weight of the toner particles, such as from about 0.1% to about 0.5% or from about 0.3% to about 0.8% by weight of the toner particles.

In embodiments, the first silica may be surface treated with polydimethylsiloxane. Such a treated silica is commercially available as RY50 from Nippon Aerosil. The second silica may be untreated silica, such as sol-gel silicas. Examples of such sol-gel silicas include, for example, X24, available from Shin-Etsu Chemical Co., Ltd. Other suitable treated fumed silicas are commercially available as TS530 from Cabot Corporation, Cab-O-Sil Division. The titania may be either treated or untreated. Untreated titania is available as P25 from Degussa. In embodiments, the titania may be surface treated, for example with a decylsilane that is commercially available as MT3103, or as SMT5103, both available from Tayca Corporation. The titania may also be surface treated, for example with a decyltrimethoxysilane which is commercially available as JMT2000. A commercially available zinc stearate is known as ZINC STEARATE L™, obtained from Ferro Corporation.

In embodiments, the external additive package may be applied to the toner surface with the total coverage of the toner ranging from, for example, about 20% to about 60% surface area coverage (SAC), such as from about 20% to about 40% or from about 30% to about 60%. Another metric relating to the amount and size of the additives is "SAC×Size" ((percentage surface area coverage) times (the primary particle size of the additive in nanometers)), for which the additives may have a total SAC×Size range between, for example, about 500 to about 4,000, such as from about 1000 to about 3000 or from about 500 to about 1500.

Additionally, it is desirable that toners and developers be functional under a broad range of environmental conditions to enable good image quality from a printer. Thus, it is desirable for toners and developers to function at low humidity and low temperature, for example at 10° C. and 15% relative humidity (denoted herein as C-zone), at moderate humidity and temperature, for example at 21° C. and 40% relative humidity (denoted herein as B-zone), and high humidity and temperature, for example at 28° C. and 85% relative humidity (denoted herein as A-zone).

For good performance under a broad range of conditions, properties of the toner and developer should change as little as possible across environmental zones described as A-zone, B-zone and C-zone. If there is a large difference across these zones, the materials may have a large relative humidity (RH) sensitivity ratio, which means that the toner may show performance shortfalls in the extreme zones, either at low temperature and humidity, or high temperature and humidity, or both. In embodiments, a RH sensitivity ratio may be expressed as a ratio of a triboelectric charge of the toner developer in the C-zone to a triboelectric charge of the toner developer in A-Zone. A goal is for the RH sensitivity ratio to be as close to one as possible. When such an RH sensitivity ratio is achieved, the toner may be equally effective in both high humidity and low humidity conditions. Stated another way, the toner has low sensitivity to changes in RH. In embodiments, the RH sensitivity ratio may be in the range from about 1 to about 2, for example from about 1.1 to about 1.7 or from about 1.1 to about 1.5.

In the process of electrophotographic printing, the step of conveying toner to the latent image on the photoreceptor, is known as development. The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads (particles). The toner particles adhere triboelectrically to the relatively large carrier particles, which are typically made of steel.

The developer may be included in an electrostatographic/xerographic device such as an eletrophotographic image forming apparatus in order to form an image upon an image receiving member such as a photoreceptor. An embodiment of an electrophotographic image forming apparatus includes a photoreceptor, development system, and a housing in association with the development system and containing the developer. The development system advances the developer material into contact with the electrostatic latent image. The electrostatic latent image attracts the toner particles from the carrier granules forming a toner power image on the photoconductive surface of the belt or drum. The toner image is then transferred to an image receiving substrate, for example paper, and the image may be fused thereon with a fuser by applying elevated temperatures, for example, from about 60° C. to about 180° C., and pressure.

In embodiments, the developer may be formed by mixing toner particles with one or more carrier particles. Carrier particles that can be selected for mixing with the toner include, for example, those carriers that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers comprised of nodular carrier beads of nickel, characterized by surfaces of reoccurring recesses and protrusions thereby providing particles with a relatively large external area. In embodiments, the carrier particles may have an average particle size of from, for example, about 20 to about 85 μm, such as from about 30 to about 60 μm or from about 35 to about 50 μm.

In embodiments, carrier particles can be mixed with the toner particles in various suitable combinations. The toner concentration in each developer ranges from, for example, about 2% to about 10% by weight of the total weight of the developer, such as from about 2% to about 8% by weight of the total weight of the developer or from about 5% to about 10% by weight of the total weight of the developer. The carrier particles in each developer may be in the range from about 90% to about 98% by weight of the total weight of the developer, such as from about 90% to about 95% by weight of the total weight of the developer or from about 93% to about 97% by weight of the total weight of the developer.

After mixing toner particles with one or more carrier particles to form developers, a number of toner properties may be measured, these properties may include, for example, toner triboelectric charge. Other properties of the toner, such as the toner cohesion, are measured before mixing the toner and carrier into the developer. The aforementioned properties may affect the performance of the developers, such as image quality degradation over time.

Toner cohesion may be measured using a Hosokawa Micron PT-R tester, available from Micron Powders Systems. Toner cohesion is typically expressed in percent (%) cohesion. Percent cohesion may be measured by placing a known mass of toner, typically 2 grams, on top of a set of stacked screens, for example a top screen that has 53 micron mesh or openings, a middle screen that has 45 micron mesh or openings, and a bottom screen that has 38 micron mesh or openings, and vibrating the screens and toner for a fixed time at a fixed vibration amplitude, for example for 90 seconds at 1 millimeter vibration amplitude. All screens are desirably made of stainless steel. In embodiments, the percent cohesion is calculated as follows:

$$\%\ \text{cohesion}=50\cdot A+30\cdot B+10\cdot C$$

where A is the mass of toner remaining on the 53 micron screen, B is the mass of toner remaining on the 45 micron screen, and C is the mass of toner remaining on the 38 micron screen. The percent cohesion of the toner is related to the amount of toner remaining on each of the screens at the end of the time. A percent cohesion value of 100% corresponds to all the toner remaining on the top screen at the end of the vibration step (50×2 grams=100) and a percent cohesion of 0% corresponds to all of the toner passing through all three screens, in other words, no toner remaining on any of the three screens at the end of the vibration step. The greater the percent cohesion for toners, the less the toner particles are able to flow. In embodiments, the toners may have a percent cohesion in the range of, for example, from about 5% to about 80%, such as from about 5 to about 40%.

Another property associated with the toners of the present disclosure is the triboelectric charge of the toner particles. In embodiments, the toners may also have a triboelectric charge in the range of, for example, from about 30 μC/g to about 70 μC/g, such as from about 40 μC/g to about 60 μC/g, or from about 35 μC/g to about 55 μC/g. Triboelectric charge may be obtained by placing 2.4 grams of toner to a 4 oz. glass jar containing 30 grams of the carrier, for example Xerox WorkCentre Pro C3545 carrier. The jar with toner and carrier is then conditioned at 21° C. and 40% relative humidity for at least 1 hour. The jar is placed on a paintshaker and shaken for 10 minutes. Triboelectric charge of the developer may then be obtained by the total blow-off method at 55 psi air pressure.

In embodiments, the toner charge may be measured after mixing the toner for one hour. The toner charge may be measured using a charge spectrograph using a 100 V/cm field. The toner charge (q/d) is measured visually as the midpoint of the toner charge distribution. The toner charge is reported in millimeters of displacement from the zero line. The charge displacement of 1 millimeter corresponds to a q/d of 0.092 femto coulombs per micron. It is desirable for the toner to display a toner charge from about 4 to about 11 mm.

Both the percent cohesion of toners and toner triboelectric charge may be associated with the trimmer clogging failure, which is a property associated with the high-gloss developers. High gloss refers, for example, to the gloss of a material being greater than about 20 gloss units, such as about 30 gloss units. In embodiments, the toners herein, may exhibit a high gloss of from about 30 to about 90 gloss units (GGU), such as from about 40 to about 70 GGU or from about 45 to about 75 GGU, as measured by the Gardner Gloss metering unit; for example on a coated paper, such as Xerox 120 gsm Digital Coated Gloss papers, or on plain paper such as Xerox 90 gsm Digital Color Xpressions+paper.

Trimmer clogging failure mode is a test used to evaluate the maximum operation temperature of the developer. During a prolonged print run, the developer housing sump can reach temperatures of up to about 52° C., for example from about 48° C. to about 52° C. This temperature range is generally known as an overheating condition for the developers. The overheating results in the developers forming clumps and building up on the transporting auger. The clumping of the developers and the sticking of the developers to the transporting auger instead of the developers being freely transported in the developer housing, in turn, results in unacceptable image quality, for example a white streak may occur along the process direction of a recording medium such as paper if the developer clumps come loose from the transporting auger and get stuck in the trim bar which has the function to remove excess developer material from the magnetic brush roll.

In order to evaluate a developer for the trimmer clogging failure, a developer is run in a Xerox DC2240 SCMB developer housing that is conditioned at 48° C. for one hour in an oven, followed by a one-hour off-line run at 350 rpm in the oven. The final temperature in the housing may increase further to about 52° C., for example from about 52° C. to about 53° C., during the test.

After the run is completed, the developer is examined visually for agglomerates and build up on the transporting auger, and assigned a visual rating of 1 to 6:

1 represents developer agglomerates <3 mm in size that occupy <10% of the surface of the developer sump;

2 represents developer agglomerates 3-5 mm in size that occupy 10-30% of the surface of the developer sump;

3 represents developer agglomerates 5-7 mm in size that occupy 30-50% of the surface of the developer sump;

4 represents developer agglomerates 7-20 mm in size that occupy 50-90% of the surface of the developer sump;

5 represents 50-90% of the developer adheres to and wraps around the auger and thus cannot be propelled by auger rotation; and 6 represents >90% of the developer adheres to and wraps around the auger and thus cannot be propelled by auger rotation.

Thus, a 1 indicates very little noticeable agglomeration, whereas a value of 6 indicates almost all the developer is agglomerated and cannot be propelled by the auger. While it may be ideal to have as low a rating as possible, more specifically a rating 1, it is acceptable to have some small amount of small clumps such as from about 5 millimeters (mm) to about 7 mm in the developer, which corresponds to a rating of 3. A rating of 4 with generation of larger clumps such as greater than 20 mm may not be considered as acceptable. Thus, acceptable performance may have a rating of less than or equal to about 3, for example from about 1 to about 3.

A statistical analysis of trimmer clogging values data, toner cohesion data and the toner triboelectric charge data found that trimmer clogging values increase with increasing toner cohesion and increasing toner triboelectric charge. Thus, a relationship among trimmer clogging value, toner cohesion and toner triboelectric charge may be established to summarize the result of the statistical analysis. The relationship may be expressed according to the equation $$\text{trimmer clogging value}=(-0.80+0.039\times(\%\ \text{toner cohesion})+0.026\times(\text{toner triboelectric charge})\ (\mu C/g)).$$

In addition, acceptable trimmer clogging values can be assured to 95% confidence if the trimmer clogging value is less than or equal to about 3.2, for example from about 0.1 to about 3.2 or from about 1 to about 3.

In embodiments, a developer having the aforementioned properties, may comprise a carrier and a toner, wherein the toner comprises toner particles of a core comprising at least one core resin and at least one colorant, a shell comprising at least one shell resin, external additives and a wax. The carrier may comprise carrier particles having an average particle size of from about 25 microns to about 35 microns and in the amount of from about 85% to about 95% by weight of the total weight of the developer. The core resin may comprise a styrene:butyl acrylate:beta carboxy ethyl acrylate in an amount of about 75% to about 80% styrene, about 20% to about 30% butyl acrylate, and about 1% to about 5% beta carboxy ethyl acrylate, by weight based upon the total weight of the monomers or oligomers. The shell resin may comprise a styrene:butyl acrylate:beta carboxy ethyl acrylate in an amount of about 80% to about 90% styrene, about 15% to about 20% butyl acrylate, and about 1% to about 5% beta carboxy ethyl acrylate. The colorant or colorants may be employed in an amount ranging from about 1% to about 8% by weight of the toner particles on a solids basis.

In addition, the external additive package includes a first silica with a mass of about 1.6% to about 1.8% by weight of the toner particles and an average primary particle size (in diameter) of from about 20 nm to about 40 nm, a second silica with a mass of about 1.6% to about 1.8% by weight of the toner particles and an average primary particle size (in diameter) of from about 100 nm to about 150 nm, a titania with a mass of about 0.7% to about 0.9% by weight of the toner particles and an average primary particle size (in diameter) of from about 10 nm to about 50 nm, an optional cerium oxide with a mass of about 0.4% to about 0.6% by weight of the toner particles and an average primary particle size (in diameter) of from about 20 nm to about 40 nm, and an optional zinc stearate with a mass of about 0.15% to about 0.25% by weight of the toner particles and an average primary particle size (in diameter) of from about 125 nm to about 145 nm.

Furthermore, the wax may be a polyethylene wax having about 6% to about 13% by weight based on the weight of the toner particles or a distilled polyethylene wax having about 6% to about 13% by weight of the toner particles.

The subject matter disclosed herein will now be further illustrated by way of the following examples.

EXAMPLES

Toner Particle Preparation

A magenta EA high gloss toner was prepared at the 20 gallon pilot plant scale, homogenizing styrene latex, a distilled polyethylene wax, PAC, Pigment Red 122 Dispersion, and Pigment Red 269 Dispersion, for 90 minutes, then aggregating to a batch temperature of 52° C. During aggregation, styrene latex was added to achieve the targeted particle size, with pH adjustment using sodium hydroxide and VERSENE-100. The process proceeded and the jacket temperature was increased to achieve batch temperature of 96° C., where the particle coalesced and spherodized for 3 hours. The particle was then cooled to 63° C., for final sodium hydroxide addition.

Particle properties of the cooled slurry were as follows:

| | |
|---|---|
| Vol. Median Diameter (D50) | 5.54 microns |
| Upper Vol. GSD (D84/D50) | 1.219 microns |
| Lower No. GSD (D50/D16) | 1.249 microns |
| Circularity | 0.967 microns |

Comparative Example A

A control toner, Comparative Example A, was prepared without the addition of calcium.

The toner wet cake was measured to contain 72% moisture by a moisture analyzer. Based on a 20 g sample by weight and accounting for the toner moisture content, a 278 g toner wet cake was weighed out in a 2 L glass beaker, into which 1.2 kg of deionized water (or DIW) water was added. The toner and DIW mixture was mixed at 400 rpm with a mechanical agitator for 40 minutes at room temperatures (or RT). Then, the toner was de-watered by a vacuum filtration process. The resulting toner was re-dispersed into the 2 L beaker for the second time with 1.2 kg of DIW. The content was allowed to mix with an agitator at 400 rpm and gradually heated up to 40° C. When the temperature of the content reached 40° C., then 6 g of previously prepared 0.3 molar nitric acid solution was added. The mixture was let mixed for 40 minutes at 40° C. Again the toner slurry was de-watered by a vacuum filtration process. The resulting wet cake for the third time was re-dispersed into a 2 L beaker with 1.2 kg of DIW at room temperature and mixed for 40 minutes. After this step, the toner was de-watered for the last time prior to the drying process. Drying of the toner was carried out by a standard freeze-drying process. The sample was labeled as control toner. In this "control experiment," the toner was not treated with calcium chloride solution.

Three toners, Examples B, C and D were prepared with calcium addition in the last wash.

Example B

The experiment was conducted with the same procedure as the above "control sample." Except during the last water washing step, the toner slurry was treated with 7.4 g of previously prepared 1% calcium chloride dihydrate solution. Such an amount of calcium chloride solution was calculated to contain approximately 100 ppm of calcium to the dry toner by weight. Then, the calcium chloride solution was added at the beginning of the last water wash and let mixed at room temperature for 40 minutes prior to de-watering and drying processes.

Example C

The experiment was conducted with the same procedure as the above "control sample." Except during the last water washing step, the toner slurry was treated with 14.7 g of previously prepared 1% calcium chloride dihydrate solution. Such an amount of calcium chloride solution was calculated to contain approximately 200 ppm of calcium to the dry toner by weight. Then, the calcium chloride solution was added at the beginning of the last water wash and let mixed at room temperature for 40 minutes prior to de-watering and drying processes.

Example D

The experiment was conducted with the same procedure as the above "control sample." Except during the last water washing step, the toner slurry was treated with 22.0 g of previously prepared 1% calcium chloride dihydrate solution. Such an amount of calcium chloride solution was calculated to contain approximately 300 ppm of calcium to the dry toner by weight. Then, the calcium chloride solution was added at the beginning of the last water wash and let mixed at room temperature for 40 minutes prior to de-watering and drying processes.

Final Toner with Additives

All toners, except for the FX control, were blended in a 10 L Henschel blender using 3.3 lb particles at 3000 rpm for 15 minutes. Additives were added in pph relative to the parent toner weight, and were 1.71% RY50 silica, 0.88% JMT2000 titania+1.73% X24 sol-gel silica, 0.55% cerium oxide+0.2% ZnSt. The toners were sieved using an Alpine Jet sieve apparatus and a 45 μm screen.

sticking to the auger instead of being freely transported in the housing. The table below shows SIR scores. Grade 4 corresponds to the "dead developer" failure.

Results

Results are summarized in the table below.

| Example | Calcium Added in Wash (ppm) | Parent Toner Charge A-zone | Parent Toner Charge C-zone | Final Toner Charge A-zone | Final Toner Charge C-zone | Cohesion (%) | Ca (ppm) | Al (ppm) | Trimmer Clogging |
|---|---|---|---|---|---|---|---|---|---|
| Target | | \|\| ≧ 4 | \|\| ≦ 20 | \|\| ≧ 4 | \|\| ≦ 11 | <40 | >20 & <100 | 100-400 | <4 |
| Xerox DC3545 Toner | 0 | −4.4 | −10.2 | −6.7 | −8.9 | 50 | 156 | 434 | 3 |
| Comparative Example A | 0 | −9.1 | −27.5 | −6.2 | −13.2 | 44.5 | 7 | 243 | |
| Example B | 100 | −5.5 | −11.3 | −3.5 | −7.5 | 20.2 | 78 | 228 | 3 |
| Example C | 200 | −3.3 | −9.4 | −3.0 | −7.4 | 16.4 | 94 | 226 | |
| Example D | 300 | −4.9 | −10.8 | −3.2 | −7.2 | 17.0 | 93 | 350 | |

Carrier

The carrier used in this study was Xerox WorkCentre Pro C3545 carrier.

Measurement of Charging

Each toner sample was blended on a sample mill for 30 seconds at 15000 rpm. Developer samples were prepared with 0.5 g of the toner sample and 10 g of the carrier. A duplicate developer sample pair was prepared as above for each toner that was evaluated. One developer of the pair was conditioned overnight in A-zone, that is 28° C./85% relative humidity (or RH), and the other was conditioned overnight in the C-zone environmental chamber, that is 10° C./15% RH. The next day the developer samples were sealed and agitated for 1 hour using a Turbula mixer. After 1 hour of mixing the toner, the tribo charge was measured using a charge spectrograph using a 100 V/cm field. The toner charge (q/d) was measured visually as the midpoint of the toner charge distribution. The charge is reported in millimeters of displacement from the zero line. The charge displacement of 1 millimeter corresponds to a q/d of 0.092 femto coulombs per micron.

Off-Line Fixture Stress Tests

It has been found that high gloss developer can be exposed to high temperature during long print runs (up to 54° C.) due to the proximity to the fuser. The overheating results in developer blocking which in turn leads to ATC sensor failure and image quality defects. Operating temperature thus becomes a critical parameter for high gloss developers.

A "trimmer clogging" test was used to evaluate the maximum operation temperature of the developer. 230 g of developer at TC=8% was placed in a Kutani developer housing in an environmental chamber at a 48° C. and 50% RH. The developer was conditioned for 1 hour and then run off-line in a zero throughout mode for another hour. Sump temperature was monitored with a thermocouple and increased during the run to 54° C. Developer blocking was examined visually against an SIR, a standard image reference. The SIR is a set of images of developer with varying severity of toner clumping. The images have been given a grade rating corresponding to increasing severity of clumping. The failure mode was associated with developer clumping and in more severe cases Charging Results The parent charge of the control Comparative Example A is very high in C-zone which results in a final toner charge with additives that is much higher than the control and much higher than the target upper limit of 11. Addition of calcium in the wash results in charge that is much lower in C-zone, lower than the DC3545 toner and within the final target range.

Since the calcium is added to the surface of the toner, less calcium is needed to provide lower charge and lower cohesion than for the control toner.

Cohesion Results

Cohesion of the control Comparative Example A is high, at 44.5%, as is the control at 50%. The high cohesion is a contributor, along with high charge, to increased trimmer clogging. Thus, many of EA high gloss toners show an undesirable trimmer clogging of 4, if both charge and cohesion is too high. Reduction of either or both of the cohesion or charge results in lower, improved trimmer clogging. Addition of calcium in the wash, as shown in the table below, reduces the cohesion very significantly, so that cohesions are all much lower than the control and are within the target range.

Trimmer Clogging Results

As noted above, higher cohesion and charge leads to higher trimmer clogging. The control toner does meet the trimmer clogging of 3, while other EA toners may not meet within the <4 target. With calcium washing, Example B did meet this target and had an acceptable trimmer clogging value of 3, due to the lower cohesion and charge level with calcium addition.

Fusing Results

Fusing results show required fusing properties, including gloss for high-gloss toner as well as improved blocking performance by about 4° C. compared to the control. To meet gloss and stripping requirements the aluminum content should be between about 200 and 500 ppm. If the aluminum content is below this level, the stripping force is too high at higher fuser temperatures, and if aluminum content is above the higher level, the gloss will be too low.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner comprising toner particles having a calcium-containing material only in a surface portion of the toner particles as a result of the toner particles having been treated with the calcium-containing material after aggregation, wherein:

the toner particles contain calcium in an amount of from about 20 ppm to about 300 ppm of calcium by dry weight of the toner, the toner particles contain a first silica and at least a second silica, the first silica has an average primary particle size of about 5 nm to about 50 nm, and the second silica has an average primary particle size of about 100 nm to about 200 nm, and the toner has a q/d charge displacement level from about 4 to about 11 mm.

2. The toner of claim 1, wherein the toner particles further comprise at least one resin, at least one colorant, and optional external additives.

3. The toner of claim 2, wherein the at least one resin is a styrene/acrylate resin.

4. The toner of claim 2, wherein the optional external additives comprise a titania, an optional cerium oxide and an optional zinc stearate.

5. The toner of claim 2, wherein the toner particles further comprise a wax.

6. The toner of claim 5, wherein the wax is selected from polyethylene wax and distilled polyethylene wax.

7. The toner of claim 1, wherein the toner particles contain aluminum in an amount of from about 100 ppm to about 500 ppm by dry weight of the toner.

8. The toner of claim 1, wherein the toner has a triboelectric charge from about 30 μC/g to about 70 μC/g.

9. A developer comprising a carrier and the toner according to claim 1.

10. A developer according to claim 9, wherein the developer has a triboelectric charge from about 30 μC/g to about 70 μC/g.

11. A process for making toner particles comprising forming toner particles by emulsion aggregation; and treating the toner particles with a calcium-containing material after aggregation, wherein:

the calcium-containing material is only in a surface portion of the toner particles as a result of the treating with the calcium-containing material, the toner particles contain calcium in an amount of from about 20 ppm to about 300 ppm of calcium by dry weight of the toner, the toner particles contain a first silica and at least a second silica, the first silica has an average primary particle size of about 5 nm to about 50 nm, and the second silica has an average primary particle size of about 100 nm to about 200 nm, and the toner has a q/d charge displacement level from about 4 to about 11 mm.

12. The process according to claim 11, wherein the toner particles are treated with a calcium chloride solution.

13. The process according to claim 11, wherein the forming of the toner particles by emulsion aggregation comprises generating an emulsion of resin by dispersing the resin in water; optionally adding to the emulsion at least one colorant dispersion, at least one wax dispersion and/or at least one surfactant; heating the emulsion and adding at least one coagulant to the emulsion, wherein the aggregate grows to a desired size; adding an optional sequestering agent; and optionally further increasing the temperature by heating to coalesce the toner particles.

14. The process according to claim 13, wherein adding the optional sequestering agent is added and substantially removes ions introduced via the coagulant.

15. The process according to claim 13, wherein the toner particles are washed with deionized water and de-watered after aggregation.

16. The process according to claim 13, wherein the latex is a styrene acrylate latex.

17. The process according to claim 13, wherein the at least one coagulant is an aluminum containing coagulant.

18. The process according to claim 11, wherein the toner has a triboelectric charge from about 30 μC/g to about 70 μC/g.

* * * * *